US006276357B1

(12) United States Patent
Edlmann et al.

(10) Patent No.: US 6,276,357 B1
(45) Date of Patent: Aug. 21, 2001

(54) COOKTOP WITH A COOKTOP FRAME

(75) Inventors: Manfred Edlmann, Schnaitsee; Bernd Stitzl, Lauter; Joachim Grützke, Zaberfeld-Leonbronn, all of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/495,962

(22) Filed: Feb. 2, 2000

(30) Foreign Application Priority Data

Feb. 2, 1999 (DE) ..... 199 04 056

(51) Int. Cl.[7] ..... F24C 15/10
(52) U.S. Cl. ..... 126/211; 126/212; 219/452.12
(58) Field of Search ..... 126/211, 217, 126/218, 219, 215, 214 B, 214 C, 214 D, 212; 219/452.12, 452.11, 460.1

(56) References Cited

U.S. PATENT DOCUMENTS

| | | | | |
|---|---|---|---|---|
| 3,561,020 | * | 2/1971 | Fritzsche | 126/211 |
| 3,567,906 | * | 3/1971 | Hurko | 219/461.1 |
| 3,586,825 | * | 6/1971 | Hurley | 219/452.12 |
| 3,674,983 | * | 7/1972 | Hurko et al. | 219/452.12 |
| 3,679,870 | * | 7/1972 | Opp | 219/452.12 |
| 3,870,862 | * | 3/1975 | Doner | 219/452.12 |
| 5,357,079 | * | 10/1994 | Henry et al. | 126/211 |
| 5,422,460 | * | 6/1995 | Bralia et al. | 126/211 |
| 5,571,434 | * | 11/1996 | Cavener et al. | 219/464 |

FOREIGN PATENT DOCUMENTS

| | | | |
|---|---|---|---|
| 38 28 799 A1 | | 3/1989 | (DE) . |
| 2 125 537 | * | 3/1984 | (GB) . |
| 2 212 260 | * | 7/1989 | (GB) . |

OTHER PUBLICATIONS

German Utility Model G 92 10 831.8, dated Dec. 10, 1992, ceramic cook top.

* cited by examiner

*Primary Examiner*—Ira S. Lazarus
*Assistant Examiner*—Josiah C. Cocks
(74) *Attorney, Agent, or Firm*—Herbert L. Lerner; Laurence A. Greenberg; Werner H. Stemer

(57) ABSTRACT

A cooktop includes a cooktop frame with at least one decorative frame strip, which entirely surrounds a one-piece cooktop panel, and with at least one decorative separating strip disposed on a top side of the cooktop panel and separating an operating area of the cooktop panel from the cooking area of the cooktop panel. In order to simplify the construction of the cooktop, the cooktop panel is configured in one piece. The at least one decorative frame strip is formed integrally with the decorative separating strip. The at least one decorative frame strip and the decorative separating strip are preferably made from high-grade steel. The decorative separating strip has at least one bead-like elevation at least over a part of it length. The at least one bead-like elevation has an underside and defines a cavity between the underside of the elevation and the top side of the cooktop panel and the cavity is substantially filled with an adhesive.

10 Claims, 1 Drawing Sheet

COOKTOP WITH A COOKTOP FRAME

BACKGROUND OF THE INVENTION

FIELD OF THE INVENTION

The invention lies in the field of cooktop appliances. The present invention relates to a cooktop, or cooking hob, with a cooktop or hob frame having at least one decorative frame strip that surrounds a cooktop panel all the way round, and with a decorative separating strip that separates an operating area of the cooktop panel from the cooking region of the cooktop panel.

A cooktop is disclosed U.S. Pat. No. 3,870,862 to Doner, wherein the cooktop panel includes two secondary cooktop panels. The two secondary cooktop panels respectively form the operating area of the cooktop and the cooking area of the cooktop, and are separated from one another by a decorative separating strip that, in addition, secures the two secondary cooktop panels together with a cooktop frame.

SUMMARY OF THE INVENTION

It is accordingly an object of the invention to provide a cooktop with a cooktop frame that overcomes the hereinafore-mentioned disadvantages of the heretofore-known devices of this general type and that simplifies the construction of the cooktop.

With the foregoing and other objects in view, there is provided, in accordance with the invention, a cooktop, including a one-piece cooktop panel having a top side, an operating area and a cooking area; and a cooktop frame having at least one frame strip entirely surrounding the cooktop panel, and a separating strip disposed on the top side of the cooktop panel and separating the operating area from the cooking area.

The object is achieved according to the invention by the cooktop panel being configured in one piece, and by the decorative separating strip being disposed on the top side of the cooktop panel. The fact that the cooktop panel is in a single piece ensures straightforward production and installation of the cooktop without losing the advantages of an operating area separated from the cooking area. Also, the area beneath the cooktop panel is easily provided with better protection against the penetration of liquid than compared to two-piece cooktop panels according to the prior art.

In accordance with another feature of the invention, the at least one decorative frame strip is advantageously formed integrally with the decorative separating strip. The configuration also simplifies the production and installation of the cooktop and, furthermore, provides a cooktop frame without separating edges or gaps.

In accordance with a further feature of the invention, the at least one frame strip and the separating strip are high-grade steel.

In accordance with an added feature of the invention, the separating strip has a given length and at least one bead-like elevation at least over a part of the given length. The bead-like elevation considerably increases the inherent stability of the decorative separating strip, which is important, in particular, when the bases of pots or pans strike against it and during cleaning in the border region between the decorative separating strip and the top side of the cooktop panel.

In accordance with an additional feature of the invention, the at least one bead-like elevation has an underside and defines a cavity between the underside and the top side of the cooktop panel, and the cavity is substantially filled with an adhesive. The cavity, receiving, for example, a silicone adhesive, is suitably dimensioned with sufficient thickness such that the adhesive can absorb stresses that occur as the cooktop is heated (resulting from the vastly differing coefficients of thermal expansion between high-grade steel and other suitable decorative-strip materials and glass ceramic or, for example, glass). The invention ensures that the decorative strip is placed in position essentially without gaps and cannot be raised off from the top side of the cooktop panel in operation.

With the objects of the invention in view, there is also provided a cooktop frame for a cooktop having a one-piece cooktop panel with a top side, an operating area and a cooking area, the cooktop frame including at least one frame strip entirely surrounding the cooktop panel; and a separating strip disposed on the top side of the cooktop panel and separating the operating area from the cooking area.

In accordance with a concomitant feature of the invention, the at least one frame strip and the separating strip each have a decorative feature.

Other features that are considered as characteristic for the invention are set forth in the appended claims.

Although the invention is illustrated and described herein as embodied in a cooktop with a cooktop frame, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
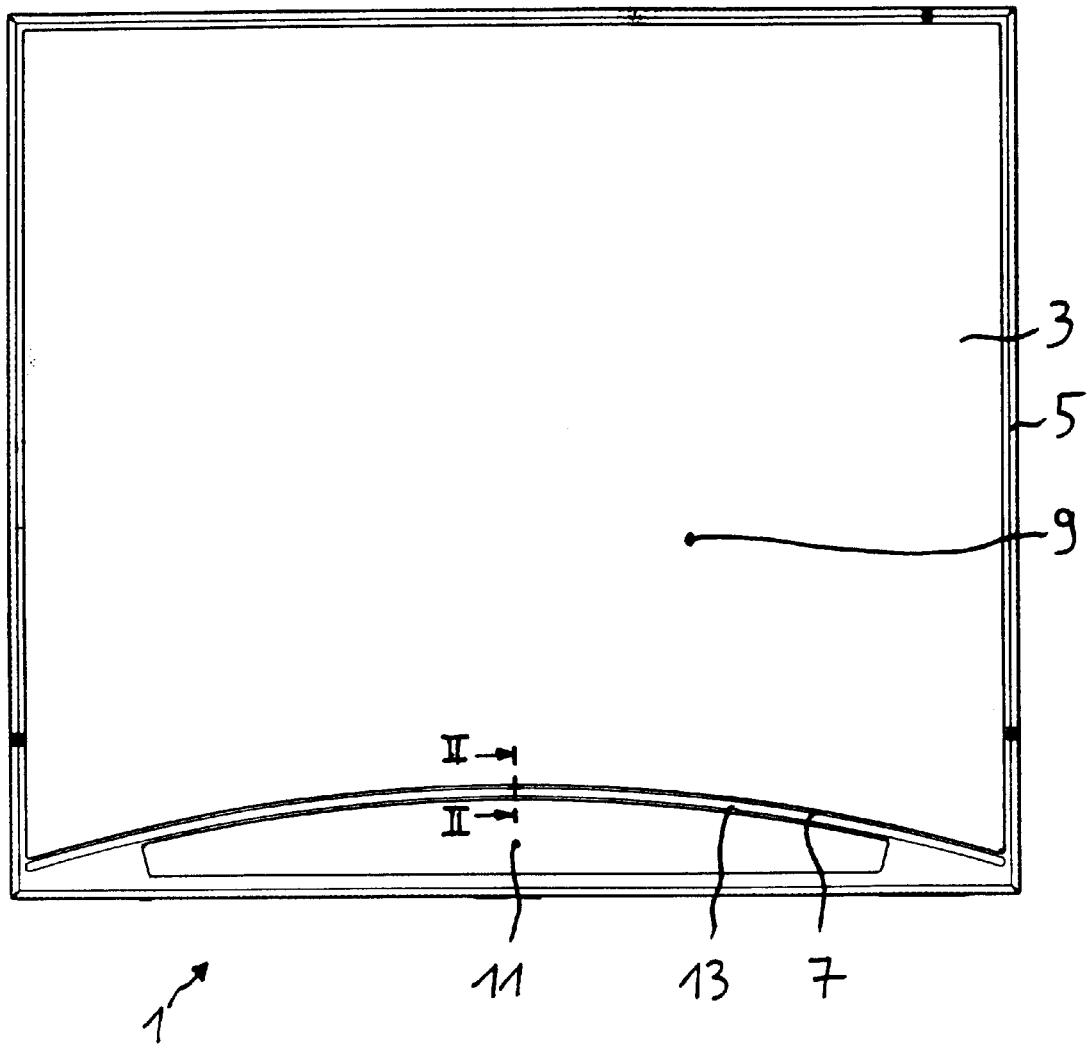
FIG. 1 is a diagrammatic plan view of the cooktop with the cooktop frame according to the invention.
Figure 2:
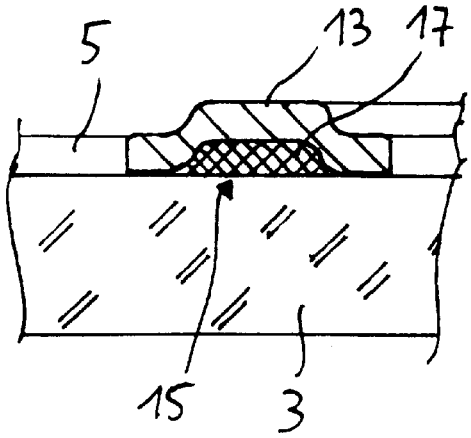
FIG. 2 is an enlarged diagrammatic sectional view of FIG. 1 along the line II—II.

A cooktop 1 has a cooktop panel 3, for example, made of glass ceramic, which is surrounded by a rectangular decorative frame strip 5. The decorative frame strip 5 is secured on the cooktop panel 3 and is preferably made of high-grade steel. Further conventional frame parts, heating elements, cooktop casings, and the like are not specifically illustrated. The decorative frame strip 5 is preferably configured approximately in the form of a non-illustrated quarter-circle in cross section and grips over the border region of the top side of the cooktop panel 3. A decorative separating strip 7, which is formed integrally with the decorative frame strip 5, extends over the width of the cooktop 1 in a front region of the cooktop. The front region is directed toward a user. The decorative separating strip 7 divides the cooktop panel 3 into a large heatable cooking area 9 and a smaller operating area 11, which is equipped with operating and, possibly, with display elements. A bead-like elevation 13 extends in the decorative separating strip 7 over essentially the entire width of the decorative frame strip 5. A cavity 15 is defined between a raised underside of the elevation 13 and a top side of the cooktop panel 3. The cavity 15 is filled with a silicone adhesive 17. Accordingly, the decorative separating strip 7 is adhesively bonded on the top side of the cooktop panel 3 essentially over its entire length. The adhesive 17 is applied in metered fashion such that it is located essentially exclusively in the immediate region of the elevation 13. This means that the decorative separating strip 7 is adhesively bonded on the surface of the cooktop panel 3 essentially without gaps. Penetration of liquid beneath the decorative frame strip 5 is, thus, made considerably more difficult, if not ruled out altogether, or, in particular, any action that would tend to lift the decorative frame strip 5 from the cooktop panel 3 is, thus, made considerably more difficult or inhibited altogether. The extent of the surface area of the operating area 11 is selected such that normal-sized pots or pans, in the operating area 11, cannot be set down directly on the surface of the cooktop panel 3 and indicator and/or operating areas provided there.

We claim:

1. A cooktop, comprising:

a one-piece cooktop panel having a top side, an operating area and a cooking area; and a cooktop frame having at least one frame strip entirely surrounding said cooktop panel, and a separating strip disposed on said top side of said cooktop panel and separating said operating area from said cooking area, said separating strip having a given length and at least one bead-like elevation at least over a part of said given length.

2. The cooktop according to claim 1, wherein said at least one frame strip is formed integrally with said separating strip.

3. The cooktop according to claim 1, wherein said at least one frame strip and said separating strip are high-grade steel.

4. The cooktop according to claim 1, wherein said at least one bead-like elevation has an underside and defines a cavity between said underside and said top side of said cooktop panel, and said cavity is substantially filled with an adhesive.

5. The cooktop according to claim 1, wherein said at least one frame strip and said separating strip each have a decorative feature.

6. A cooktop frame for a cooktop having a one-piece cooktop panel with a top side, an operating area and a cooking area, the cooktop frame comprising:

at least one frame strip entirely surrounding the cooktop panel; and a separating strip disposed on the top side of the cooktop panel and separating the operating area from the cooking area, said separating strip having a given length and at least one bead-like elevation at least over a part of said given length.

7. The cooktop frame according to claim 6, wherein said at least one frame strip is formed integrally with said separating strip.

8. The cooktop frame according to claim 6, wherein said at least one frame strip and said separating strip are high-grade steel.

9. The cooktop frame according to claim 6, wherein said at least one bead-like elevation has an underside and defines a cavity between said underside and said top side of said cooktop panel, and said cavity is substantially filled with an adhesive.

10. The cooktop according to claim 6, wherein said at least one frame strip and said separating strip each have a decorative feature.

* * * * *